US007866414B2

(12) United States Patent
Patel

(10) Patent No.: US 7,866,414 B2
(45) Date of Patent: Jan. 11, 2011

(54) ACTIVE INTEGRATED WELL COMPLETION METHOD AND SYSTEM

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 17 days.

(21) Appl. No.: 12/331,602

(22) Filed: Dec. 10, 2008

(65) Prior Publication Data

US 2009/0151950 A1 Jun. 18, 2009

Related U.S. Application Data

(60) Provisional application No. 61/013,068, filed on Dec. 12, 2007.

(51) Int. Cl.
*E21B 7/06* (2006.01)

(52) U.S. Cl. ..... 175/61; 166/313; 166/50; 166/205

(58) Field of Classification Search ..... 175/61; 166/369, 50, 205
See application file for complete search history.

(56) References Cited

U.S. PATENT DOCUMENTS

| | | | | |
|---|---|---|---|---|
| 6,041,864 | A | 3/2000 | Patel et al. | |
| 6,209,648 | B1 | 4/2001 | Ohmer et al. | |
| 6,302,203 | B1 | 10/2001 | Rayssiguier et al. | |
| 6,360,820 | B1 | 3/2002 | Laborde et al. | |
| 6,422,312 | B1 | 7/2002 | Delatorre et al. | |
| 6,513,599 | B1 | 2/2003 | Bixenman et al. | |
| 6,722,437 | B2 | 4/2004 | Vercaemer et al. | |
| 6,789,621 | B2 | 9/2004 | Wetzet et al. | |
| 2002/0195247 | A1 | 12/2002 | Ciglenec et al. | |
| 2004/0069487 | A1 | 4/2004 | Cook et al. | |
| 2004/0094303 | A1 * | 5/2004 | Brockman et al. | 166/313 |
| 2007/0227727 | A1 | 10/2007 | Patel et al. | |
| 2008/0223585 | A1 | 9/2008 | Patel et al. | |
| 2009/0066535 | A1 * | 3/2009 | Patel et al. | 340/853.2 |

FOREIGN PATENT DOCUMENTS

| | | | |
|---|---|---|---|
| GB | 2436579 | A | 10/2007 |

* cited by examiner

*Primary Examiner*—William P Neuder

(57) ABSTRACT

A well system may be provided comprising a first primary inductive coupler configured to be communicably coupled to a surface device and a first secondary inductive coupler. The first secondary inductive coupler may be further configured to be communicably coupled to one or more completion components provided in a first portion of the well. In addition, the well system may comprise a second primary inductive coupler configured to be communicably coupled to the surface device and a second secondary induction coupler. The second secondary inductive coupler may be further configured to be communicably coupled to one or more completion components provided in a second portion of the well. The flow through at least one of the first and second portions of the well may be adjusted via at least one of the one or more completion components. A method for completing a well comprising inductive couplers may also be provided.

33 Claims, 10 Drawing Sheets

100
60
62
64
65
70
68
66
16
67
69
48
42
48
42
47
14
46
34B
30B
44
40
50
34A
30A
23
22
20
12
24
5

ACTIVE INTEGRATED WELL COMPLETION METHOD AND SYSTEM

RELATED APPLICATIONS

This application is related to U.S. patent application Ser. No. 11/948,177, entitled "Flow Control Assembly Having a Fixed Flow Control Device and An Adjustable Flow Control Device," filed Nov. 30, 2007, and U.S. patent application Ser. No. 11/948,201, entitled "Providing a Removable Electrical Pump in a Completion System," filed Nov. 30, 2007, both of which claim priority to U.S. Provisional Application Ser. No. 60/894,495, entitled "Method and Apparatus for an Active Integrated Well Construction and Completion System for Maximum Reservoir Contact and Hydrocarbon Recovery," filed Mar. 13, 2007, and U.S. Provisional Application Ser. No. 60/895,555, entitled "Method and Apparatus for an Active Integrated Well Construction and Completion System for Maximum Reservoir Contact and Hydrocarbon Recovery," filed Mar. 30, 2007; each of which is hereby incorporated by reference in its entirety. This application claims the benefit of priority to U.S. Provisional Application Ser. No. 61/013,068, entitled "Method and Apparatus for an Active Integrated Well Construction and Completion System for Maximum Reservoir Contact and Hydrocarbon Recovery," filed Dec. 12, 2007, the contents of which are hereby incorporated by reference in their entirety.

BACKGROUND

1. Field of the Invention

Embodiments of the present invention generally relate to an integrated intelligent completion system configured to provide increased reservoir contact for facilitating reservoir drainage and hydrocarbon recovery from a well. Specifically, some embodiments of the well system may include wireless communication and control and be configured as multiple sections in a single bore, a bore with one or more multilateral branch sections, or a combination of the various configurations.

2. Description of the Related Art

The following descriptions and examples are not admitted to be prior art by virtue of their inclusion in this section.

Maximum and extreme reservoir contact wells are drilled and completed with respect to maximizing total hydrocarbon recovery. These wells may be long and horizontal, and in some cases may have several multilateral branches. Sensors and flow control valves may be used for measurement and flow control in order to optimize recovery from the wells.

Flow control valves and sensors may be run in the mother bore for reservoir monitoring and flow control from the mother bore as well from the multilateral branches. Typically an electrical cable or hydraulic control line is run from the surface to supply power and provide communication to sensors and a flow control valve. Sometimes more than one set of sensors and flow control valves may be run in a mother bore in a reservoir having multiple zones. However, only one flow control valve and sensor set is run per multilateral branch in the mother bore. Running multiple flow control valves and sensors in the mother bore and establishing a physical connection such as an electrical and hydraulic wet connect between the mother bore and lateral branch is not done due to the complexity of establishing the connections and concern for poor reliability.

As a result, there is a need for an integrated well construction, drilling and completion system configured to maximize total hydrocarbon recovery.

SUMMARY

In general, the present invention provides an integrated well construction, drilling and completion system configured to maximize total hydrocarbon recovery. The completion system may provide segments of wireless communication between an upper completion and the valves and sensors located in the lower completion, or between the mother bore and the valves and sensors located in one of the lateral branches. An autonomous power supply may be provided in each lateral branch in order to power the sensors and flow control valves therein since there is no direct physical connection between the communication and power system of the mother bore and the corresponding systems of the various lateral branches.

More specifically, one embodiment of the present invention provides a downhole communication system for a completed wellbore having a mother bore and at least one lateral branch, wherein at least one of the communication system segments of the lateral branches or downhole sections is not physically connected to a corresponding communications segment of the mother bore (e.g., via an electrical or hydraulic wet connection for example, among other types of physical connections). The system may include an upper two-way inductive coupler disposed within the mother bore and connected to a first power source, and at least two lower two-way inductive couplers disposed within the completed wellbore wherein at least one of the lower two-way inductive couplers may be disposed within each of the lateral branches or lower downhole sections. The system may also include at least one sensor adapted to measure downhole parameters and communicably coupled to the upper two-way inductive coupler or the lower two-way inductive couplers, and at least one flow control valve communicably coupled to the upper two-way inductive coupler or the lower two-way inductive couplers.

Other or alternative features will become apparent from the following description, from the drawings, and from the claims.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various described technologies described. The drawings are as follows.

DETAILED DESCRIPTION

Figure 1:
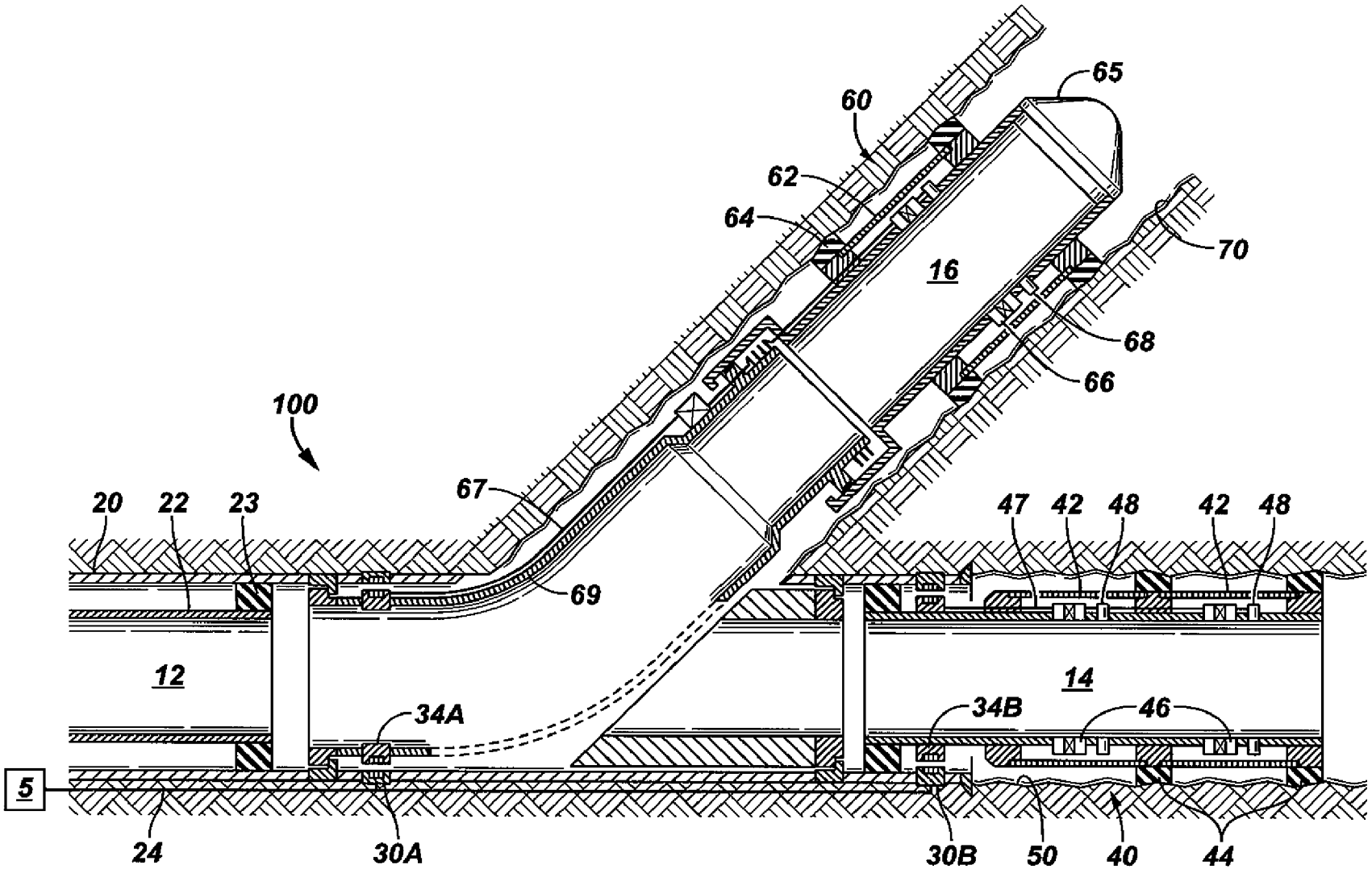
FIG. 1 is a cross-sectional schematic view of a well system with a multilateral branch and a single cable communicably coupled to one or more primary inductive couplers and located outside of casing, in which the primary inductive couplers are run in hole as part of the casing string, according to an embodiment of the present invention.

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and "downwardly"; "below" and "above"; and other similar terms indicating relative positions above or below a given point or element may be used in connection with some implementations of various technologies described herein. However, when applied to equipment and methods for use in wells that are deviated or horizontal, or when applied to equipment and methods that when arranged in a well are in a deviated or horizontal orientation, such terms may refer to a left to right, right to left, or other relationships such as upstream or downstream as appropriate. In the specification and appended claims: the terms "connect", "connection", "connected", "in connection with", "connecting", "couple", "coupled", and "coupling" are used to mean "in direct connection with" or "in connection with via another element"; and the term "set" is used to mean "one element" or "more than one element". Further, the terms "communicably coupled" may mean "electrically or inductively coupled" for the purposes of passing data and power either directly or indirectly between two points.

Embodiments of the present invention may generally relate to an integrated completion system configured to provide increased reservoir contact for facilitating reservoir drainage and maximizing ultimate hydrocarbon recovery from a well. The well may include a single bore, such as a long horizontal section, one or more lateral branch sections, or a combination of configurations. Where the well passes through the reservoir, the reservoir section of the well may be compartmentalized into one or more zones. Each compartment of the reservoir section may be isolated from one another through the use of reservoir isolation devices (e.g., swell packers, chemical packers, or mechanical packers, among others). One or more active flow control devices (FCDs) and/or desired measurement sensors (e.g pressure, temperature, flow, fluid identification, flow control valve position, density, chemical, pH, viscosity, or acoustic, among others) may be run with the completion in order to manage each compartment or multiple compartments in real time from the drilling surface without requiring an intervention.

Active FCDs in some embodiments may mean FCDs that are adjustable after running downhole. For example, a hydraulically, electrically, or electromechanically controlled variable choke may be one embodiment of an active FCD, although the current invention may not be limited to this one illustrative example. Passive FCDs in some embodiments may include flow control devices that are initially configured at the surface and retain their settings after run in or systems that react to the surrounding environment, such as chokes that have a perforated swellable material that is configured to shut off inflow through the choke in the presence of water for example, although the current invention may not be limited to these illustrative examples. In addition, one or more screens may also be run in the completion across the formations and configured to filtrate solids or other particulate contaminates.

One or more electric cables and/or hydraulic control lines from the drilling surface may be run to provide communication and power to each active FCD and sensor, as needed. Exemplary embodiments may route the data and command communications and power supplies between a primary or "mother" bore and a lateral branch or various multilateral branches through the use of one or more inductive couplers. Additionally, other embodiments of the present invention detail a method for constructing a lateral or multilateral junction and running the completions in the mother bore and in the branches. As used herein, the term "multilateral" refers to one or more laterals or branches that extend from the primary or mother bore.

An exemplary embodiment of some aspects of the present invention is shown in FIG. 1. In this figure, a well system 100 may comprise an upper mother bore section 12, a lower mother bore section 14 and a single multilateral branch section 16. Only one multilateral branch section 16 is shown in order to simplify the detailed description. A person of skill in the art will recognize that aspects of the present invention may also be applied to two or more multilateral branch sections, a single mother bore with multiple compartments or zones, or various combinations of configurations as appropriate.

In this illustrative embodiment, a communications and/or power cable 24 configured to be communicably coupled to a surface device 5 may be run along with casing 20. The surface device 5 may be a monitoring and/or control station for example. In other embodiments, the surface device 5 may be located intermediate to the location of the two-way inductive couplers and the drilling surface of the well. In still other embodiments, the surface device 5 may be a transmitter/receiver configured to allow for monitoring and control of the well from a remote site. The surface device 5 may be provided at a terrestrial or subsea location. In other embodiments, multiple well systems may be communicably coupled to a single surface device 5. The surface device 5 may further comprise multiple components or a single component.

A single common cable 24 may extend along the exterior of the casing 20 and be configured to be communicably coupled with one or more primary inductive couplers 30. Two sets of primary inductive couplers are illustrated in this embodiment as female inductive couplers provided on the exterior of the casing 20. The primary inductive couplers 30 may be run with casing 20 as part of the casing string. A first or "upper" primary inductive coupler 30A may be provided upstream of the multilateral branch junction and communicably coupled to various components of the completion located in the multilateral branch section 16, and a second or "lower" primary inductive coupler 30B may be provided downstream of the multilateral branch junction and communicably coupled to the various components of the completion located in the lower mother bore section 14.

A lower mother bore completion 40 including one or more second or "lower" secondary inductive couplers 34B (shown in this illustrative embodiment as a male inductive coupler), screens 42, isolation packers 44, active FCDs 46, and sensors 48 may be run below the multilateral branch section 16 and extend beyond the end of the cemented casing 20 into the lower open hole bore 50. Although only active FCDs 46 are shown in this figure, both active and passive FCDs may be used either singly or in combination with one another. In some embodiments, no FCDs may be present in a particular section, only a sensor or other powered component. Additionally, active FCDs 46 and sensors 48 may be used either singly or in combination with one another as appropriate. Some embodiments may include downhole energy storage devices (e.g., batteries, capacitors, resilient members, among others) in order to provide operating power for actuating a valve or other form of FCD for example, or other downhole component, based on a signal communicated via the inductive couplers. In other cases, downhole energy storage devices will provide power for sensors used to measure various well parameters.

The lower secondary inductive couplers 34B may be communicably coupled to the active FCDs 46 and sensors 48 via a lower mother bore cable 47. The lower mother bore cable 47 may provide access to communication, power, or both to the active FCDs 46 and sensors 48 as needed. The primary and corresponding secondary inductive couplers 30B and 34B of the downstream set of inductive couplers may ultimately communicably couple the active FCDs 46 and sensors 48 via the single common cable 24 to the surface device 5. A deflector may further be run to just upstream of the lower mother bore completion 40 and aligned with indexed casing couplers (ICC) to facilitate the drilling of a multilateral branch section 16.

Two lower mother bore completion zones are illustrated in the exemplary embodiment shown in FIG. 1. Each completion zone may include some or all of a screen 42, an active FCD 46, and a sensor 48, among other downhole components such as an energy storage device for example. The zones may be independently controlled in order to maximize hydrocarbon production while minimizing water inflow or equalizing production across the lower mother bore section. As shown in the figure, the zones may compartmentalize the lower open hole bore 50 via the use of one or more isolation packers 44.

The multilateral branch section 16 may be formed using the deflector located above the lower mother bore completion 40. A multilateral branch completion 60 including screen 62, isolation packers 64, bull nose 65, active FCD 66, and sensor 68 may be run in the multilateral open hole 70 of the multilateral branch section 16. As with the lower mother bore completion 40, both active and passive FCDs may be used either singly or in combination with one another. Additionally, the active FCD 66 and sensor 68 may be used either singly or in combination with one another.

In this exemplary embodiment, only one completion zone is illustrated as being provided in the multilateral branch section 16. Each completion zone may include some or all of a screen 62, an active FCD 66 and a sensor 68, among other downhole components such as an energy storage device for example. In some cases, multiple compartmentalized zones may be provided in a single multilateral branch. As shown in the figure, the zones may compartmentalize the multilateral open hole bore 70 via the use of one or more isolation packers 64.

The multilateral branch completion 60 may further include a multilateral liner 69 coupled through the use of a swivel to the remaining multilateral branch completion components. In some cases, the liner 60 may comprise a pre-milled window allowing fluid communication with the lower mother bore section 14. The liner 69 may be aligned and located in the casing 20 using ICCs. The liner 69 may further include a set of first or "upper" secondary inductive couplers 34A aligning with the upstream set of primary inductive couplers 30A of the casing 20. The multilateral secondary inductive coupler 34A may be communicably coupled to the active FCD 66 and sensor 68 via a multilateral cable 67. The multilateral cable 67 may provide access to communication, power, or both, as needed. The multilateral secondary inductive coupler 34A of the liner 69 and corresponding upper primary inductive couplers 30A of the casing 20 may ultimately communicably couple the active FCD 66 and sensor 68 of the multilateral branch section 16 via the single common cable 24 to the surface device 5.

Hydrocarbons produced in either the multilateral branch section 16 and/or the lower mother bore section 14 may be combined to flow to the surface via production tubing 22 provided in the casing 20 and located in the upper mother bore section 12. The production tubing 22 may be run in and sealingly coupled to the casing 20 via tubing packers 23.

Figure 2:
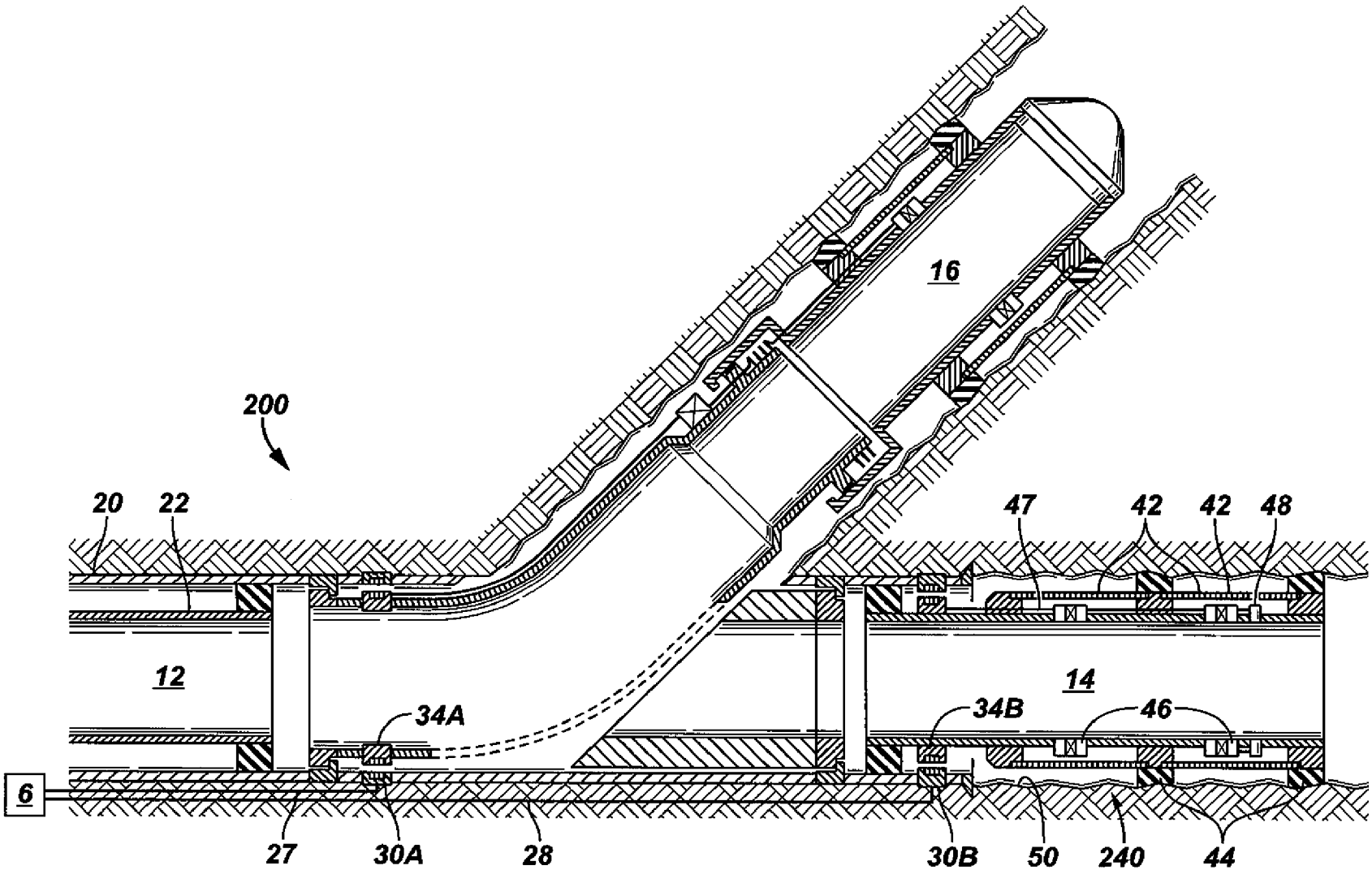
FIG. 2 is a cross-sectional schematic view of a well system with a multilateral branch and two cables respectively communicably coupled to corresponding primary inductive couplers and located outside of casing, in which the primary inductive couplers are run in hole as part of the casing string, in accordance with an embodiment of the invention.

Referring generally to FIG. 2, this drawing illustrates another embodiment of the present invention. In this figure, a well system 200 may comprise an upper mother bore section 12, a lower mother bore section 14 and a single multilateral branch section 16. As with the previous illustrative embodiment, only one multilateral branch section 16 is shown in order to simplify the detailed description.

In this exemplary embodiment, two communications and/or power cables configured to be communicably coupled to a surface device 6 may be run along with casing 20. Although the cables may be described as being configured to be communicably coupled to the surface device 6, it should be recognized that the cables may comprise one or more sections of cable coupled together and may include one or more wireless sections. A first cable 27 may extend along the exterior of the casing 20 and be communicably coupled with the upper primary inductive coupler 30A. A second cable 28 may extend along the exterior of the casing 20 and be communicably coupled with the lower primary inductive coupler 30B. The use of individual cables coupled to corresponding primary inductive couplers may provide for more robust and reliable connections to each set of primary inductive couplers 30A and 30B along with an increased capacity for passage of communication or power. Further, a failure of one of the first and second cables 27 and 28 would not necessarily result in a complete loss of communication and control to all of the various completion sections.

A lower mother bore completion 240 including a lower secondary inductive coupler 34B, screens 42, isolation packers 44, active FCDs 46, and a sensors 48 may be run below the multilateral branch section 16 and extend beyond the cemented casing 20 into the lower open hole bore 50. The lower mother bore completion 240 is shown as compartmentalized into two zones. The first zone (upstream, nearest to the multilateral junction) may comprise a screen 42 and active FCD 46. The second zone (downstream of the first zone) may comprise a screen 42, active FCD 46, and sensor 48. In some cases, downhole energy storage devices (e.g., batteries, capacitors, resilient members, among others) will provide operating power for actuating a valve or other form of FCD for example, or for operating another downhole component based on a signal communicated via the inductive couplers. In other cases, downhole energy storage devices will provide power for sensors used to measure various well parameters.

The active FCDs 46 and sensor 48 may be communicably coupled to the lower secondary inductive coupler 34B via a lower mother bore cable 47. The lower mother bore cable 47 may provide access to communication, power, or both, for the active FCDs 46 and sensor 48 as needed. The primary and corresponding secondary inductive couplers 30B and 34B of the downstream set of inductive couplers may ultimately communicably couple the active FCDs 46 and sensor 48 via the cable 28 to the surface device 6. The multilateral section 16 may be ultimately communicably coupled via the cable 26 to the surface device 6.

Figure 3:
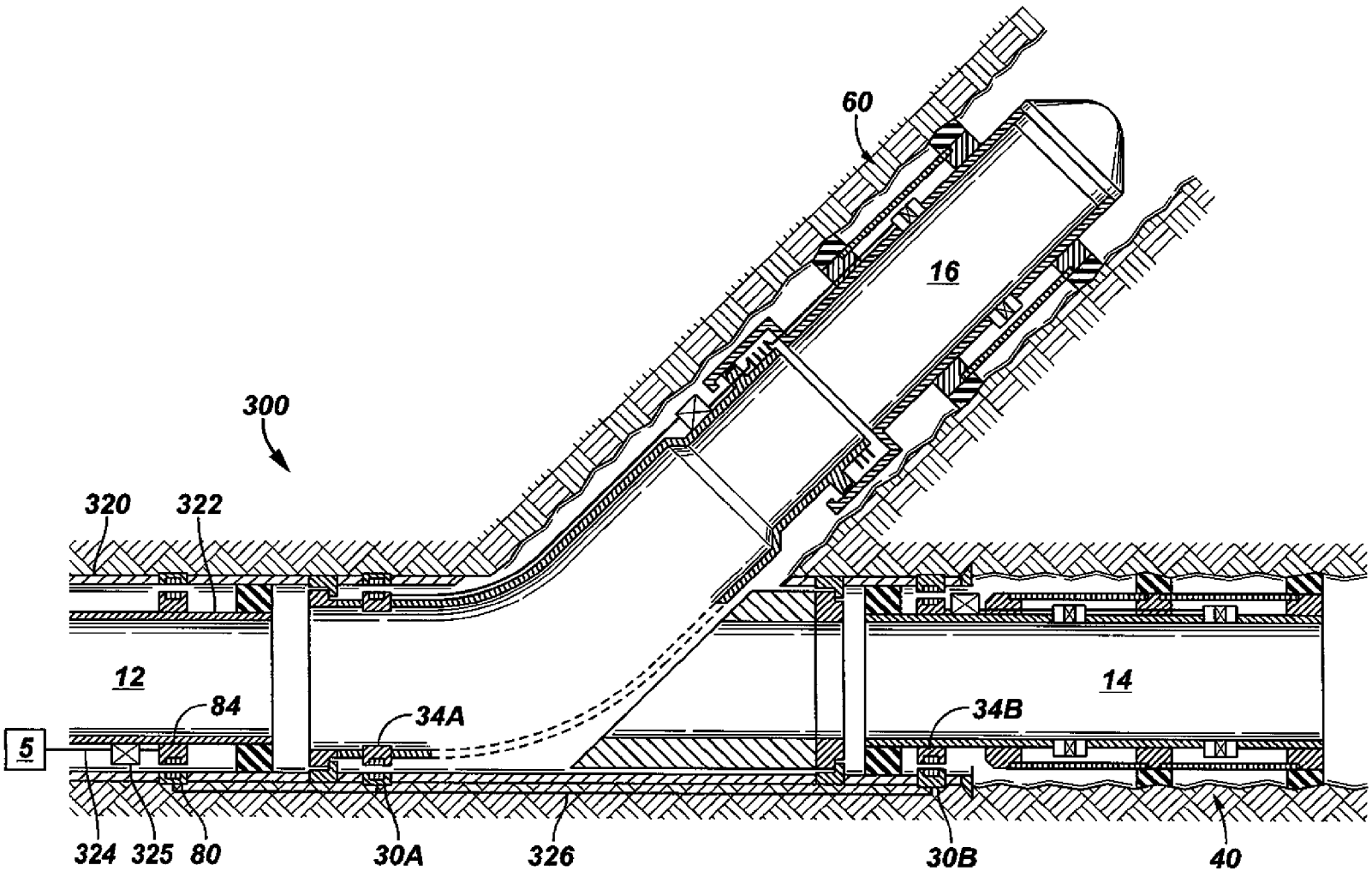
FIG. 3 is a cross-sectional schematic view of a well system with a multilateral branch and a single cable communicably coupled to a main secondary inductive coupler and located outside of production tubing, in which the main secondary inductive coupler is ran in hole as part of the tubing string, in accordance with an embodiment of the invention.

Turning now to FIG. 3, this drawing illustrates another embodiment of the present invention. In this figure, a well system 300 may comprise an upper mother bore section 12, a lower mother bore section 14 and a single multilateral branch section 16. In this illustrative embodiment, a communications and/or power cable 324 configured to be communicably coupled to a surface device 5 may be located along the outside of the production tubing 322. The single common cable 324 may extend along the exterior of the production tubing 322 and be communicably coupled with one or more main secondary inductive couplers 84. Only one main secondary inductive coupler 84 is shown in the figure. The cable 324 and the one or more main secondary inductive couplers 84 may be run in along with the production tubing 322.

The main secondary inductive coupler 84 may be communicably coupled with a main primary inductive coupler 80 located on the exterior of the casing 320. The main secondary inductive coupler 84 may be communicably coupled with the surface device 5 via the cable 324 and electronic control module 325. The electronic control module 325 may be configured to interpret and route communication and/or power to the various devices located in the well system. In addition, the electronic control module 325 may be responsible for collecting the raw data from the sensors and active FCDs and placing the data in a proper format for transmission to the surface device 5. The main primary inductive coupler 80, electronic control module 325, and other primary inductive couplers and cables may be run in along with the casing 320 and cemented in place.

The main primary inductive coupler 80 may be communicably coupled with an upper primary inductive coupler 30A and a lower primary inductive coupler 30B via a single common cable 326. As previously described, the upper and lower primary inductive couplers 30A and 30B may be respectively communicably coupled with an upper secondary inductive coupler 34A and a lower secondary inductive coupler 34B. The upper secondary inductive coupler 34A may further be communicably coupled with a multilateral completion 60 located in the multilateral branch section 16. The lower secondary inductive coupler 34B may further be communicably coupled with a lower mother bore completion 40 located in the lower mother bore section 14.

Figure 4:
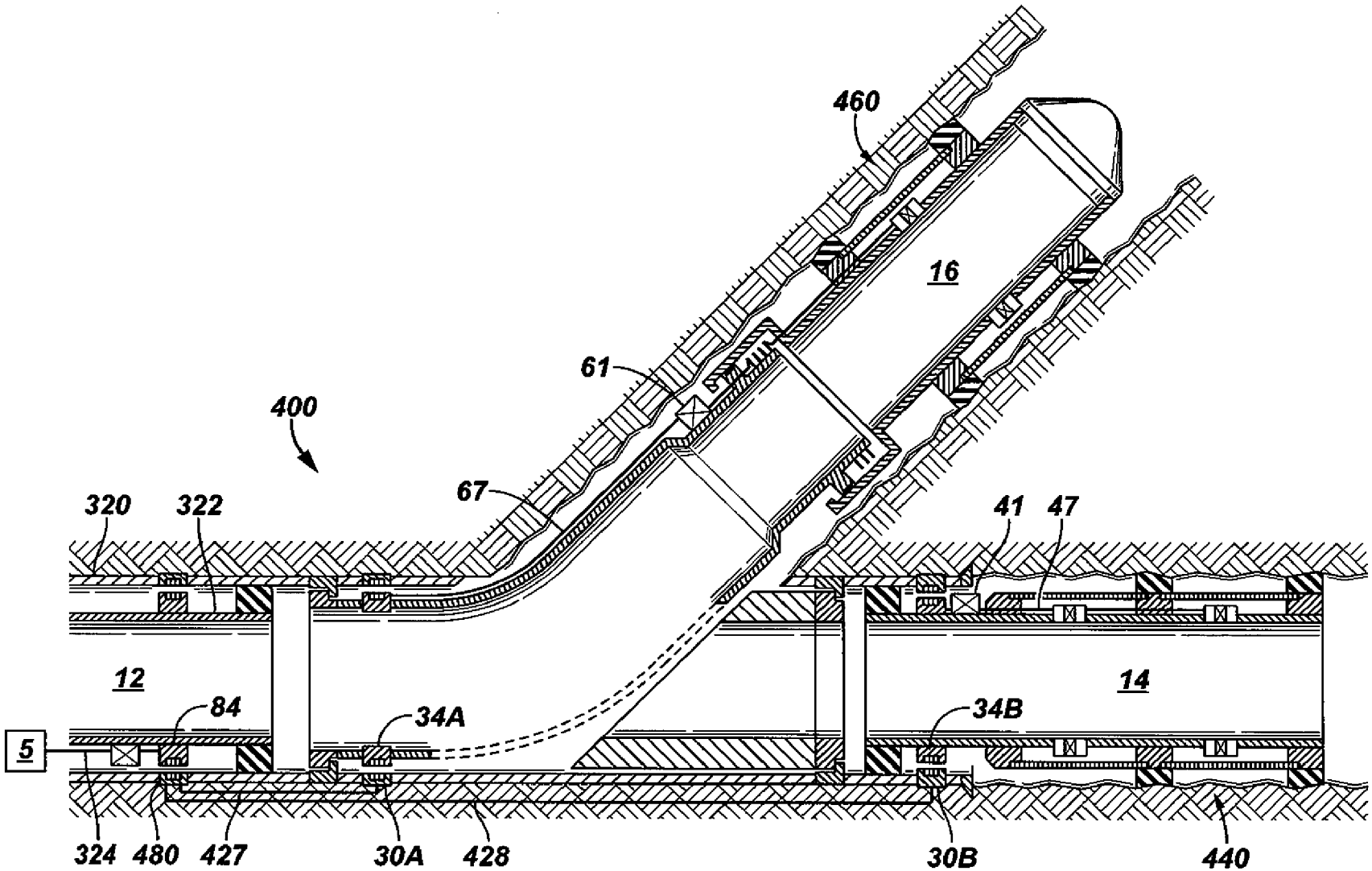
FIG. 4 is a cross-sectional schematic view of a well system with a multilateral branch and a single cable communicably coupled to a main secondary inductive coupler and located outside of production tubing, in which individual cables are communicably coupled to each of the primary inductive couplers located outside of casing and run in hole as part of the casing string, in accordance with an embodiment of the invention.

Referring generally to FIG. 4, this drawing illustrates another embodiment of the present invention. In this figure, a well system 400 may comprise an upper mother bore section 12, a lower mother bore section 14 and a single multilateral branch section 16. In this illustrative embodiment, a communications and/or power cable 324 configured to be communicably coupled to the surface device 5 may be run along the outside of the production tubing 322. A single common cable 324 may extend along the exterior of the production tubing 322 and be connected to one or more main secondary inductive couplers 84. Only one main secondary inductive coupler 84 is shown in the figure. The cable 324 and the one or more main secondary inductive couplers 84 may be run in along with the production tubing 322. The main secondary inductive coupler 84 may be communicably coupled with a main primary inductive coupler 480 located on the exterior of the casing 320.

The main primary inductive coupler 480 may be communicably coupled with an upper primary inductive coupler 30A via a first cable 427, and a lower primary inductive coupler 30B via a second cable 428. As previously described, the upper and lower primary inductive couplers 30A and 30B may be respectively communicably coupled with an upper secondary inductive coupler 34A and a lower secondary inductive coupler 34B. The upper secondary inductive coupler 34A may further be communicably coupled with a multilateral completion 460 located in the multilateral branch section 16. The lower secondary inductive coupler 34B may further be communicably coupled with a lower mother bore completion 440 located in the lower mother bore section 14.

The upper secondary inductive coupler 34A may communicate and/or transmit power to and from various electronic components of the multilateral completion 460, such as active FCDs, sensors, and energy storage devices, among others. The upper secondary inductive coupler 34A may be communicably coupled to these electronic components via a multilateral cable 67 and a multilateral electronic control module 61. The multilateral electronic control module 61 may be configured to route, format, or otherwise control the distribution of control signals and/or power to and from the various electronic components.

The lower secondary inductive coupler 34B may communicate and/or transmit power to and from various electronic components of the lower mother bore completion 440, such as active FCDs, sensors, control modules, and energy storage devices, among others. The lower secondary inductive coupler 34B may be communicably coupled to these electronic components via a lower mother bore cable 47 and a lower mother bore electronic control module 41. The lower mother bore electronic control module 41 may be configured to route, format, or otherwise control the distribution of control signals and/or power to and from the various electronic components.

Figure 5:
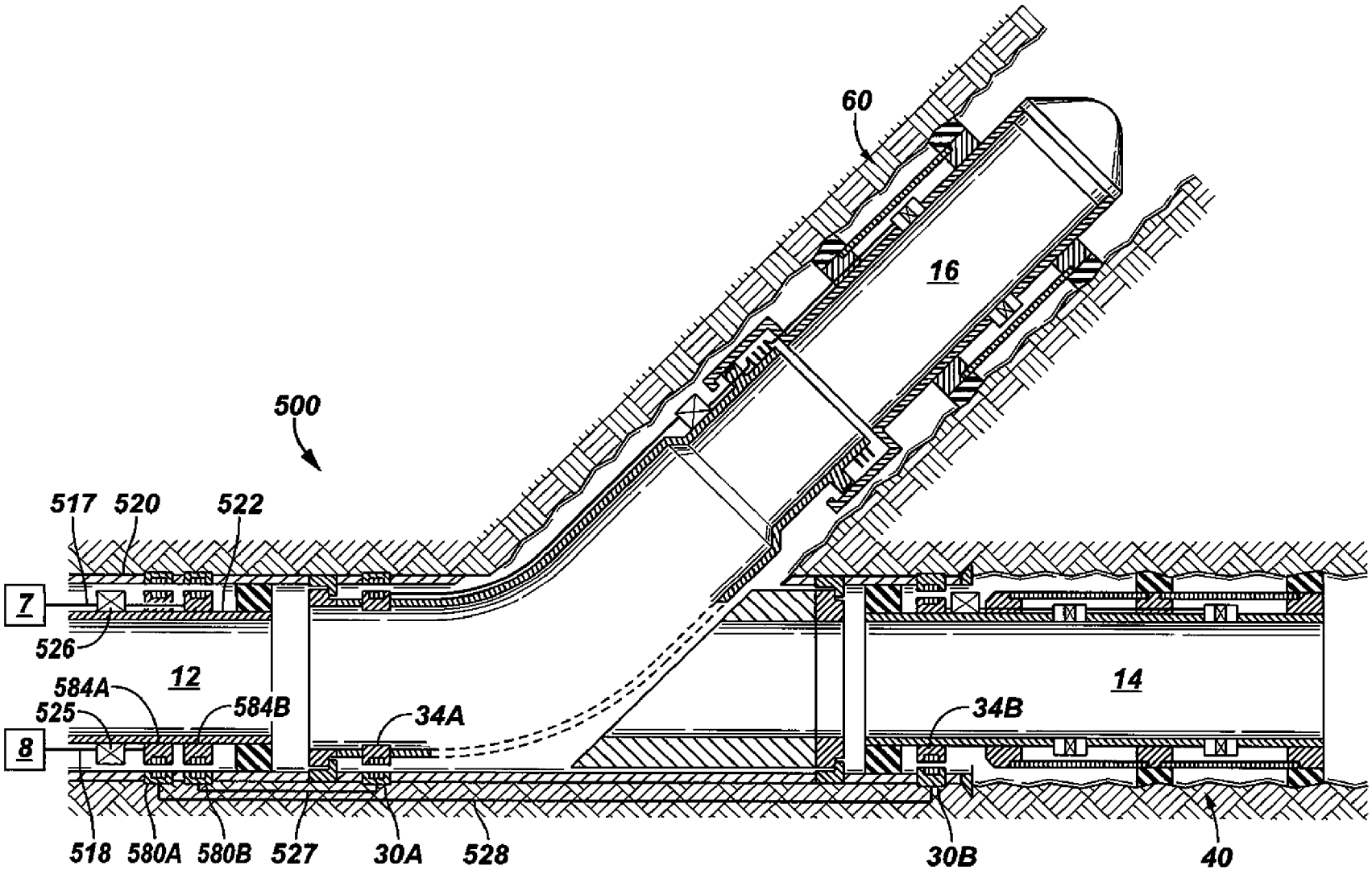
FIG. 5 is a cross-sectional schematic view of a well system with a multilateral branch and two cables respectively communicably coupled to first and second main secondary inductive couplers located outside of the production tubing, in which individual cables are communicatively coupled to each of the primary inductive couplers located outside of casing and run in hole as part of the casing string, in accordance with an embodiment of the invention.

Turning now to FIG. 5, this drawing illustrates another embodiment of the present invention. In this figure, a well system 500 may comprise an upper mother bore section 12, a lower mother bore section 14, and a single multilateral branch section 16. In this illustrative embodiment, a communications and/or power first cable 517 is configured to be communicably coupled to a first surface device 7 and a communications and/or power second cable 518 is configured to be communicably coupled to a second surface device 8. Both the first cable 517 and the second cable 518 may be located along the outside of the production tubing 522 and run in hole along with the production tubing 522.

The first cable 517 may be communicably coupled to a first electronic control module 526 and a first main secondary inductive coupler 584B. The first main secondary inductive coupler 584B may be communicably coupled to a first main primary inductive coupler 580B located proximate the exterior surface of the casing 520. The first main primary inductive coupler 580B may further be communicably coupled to the upper primary inductive coupler 30A. The upper primary inductive coupler 30A may further be communicably coupled to the upper secondary inductive coupler 34A and the various components of the multilateral completion 60.

The second cable 518 may be communicably coupled to a second electronic control module 525 and a second main secondary inductive coupler 584A. The second main secondary inductive coupler 584A may be communicably coupled to a second main primary inductive coupler 580A located proximate the exterior surface of the casing 520. The second main primary inductive coupler 580A may further be communicably coupled to the lower primary inductive coupler 30B. The lower primary inductive coupler 30B may further be communicably coupled to the lower secondary inductive coupler 34B and the various components of the lower mother bore completion 40.

Figure 6A:
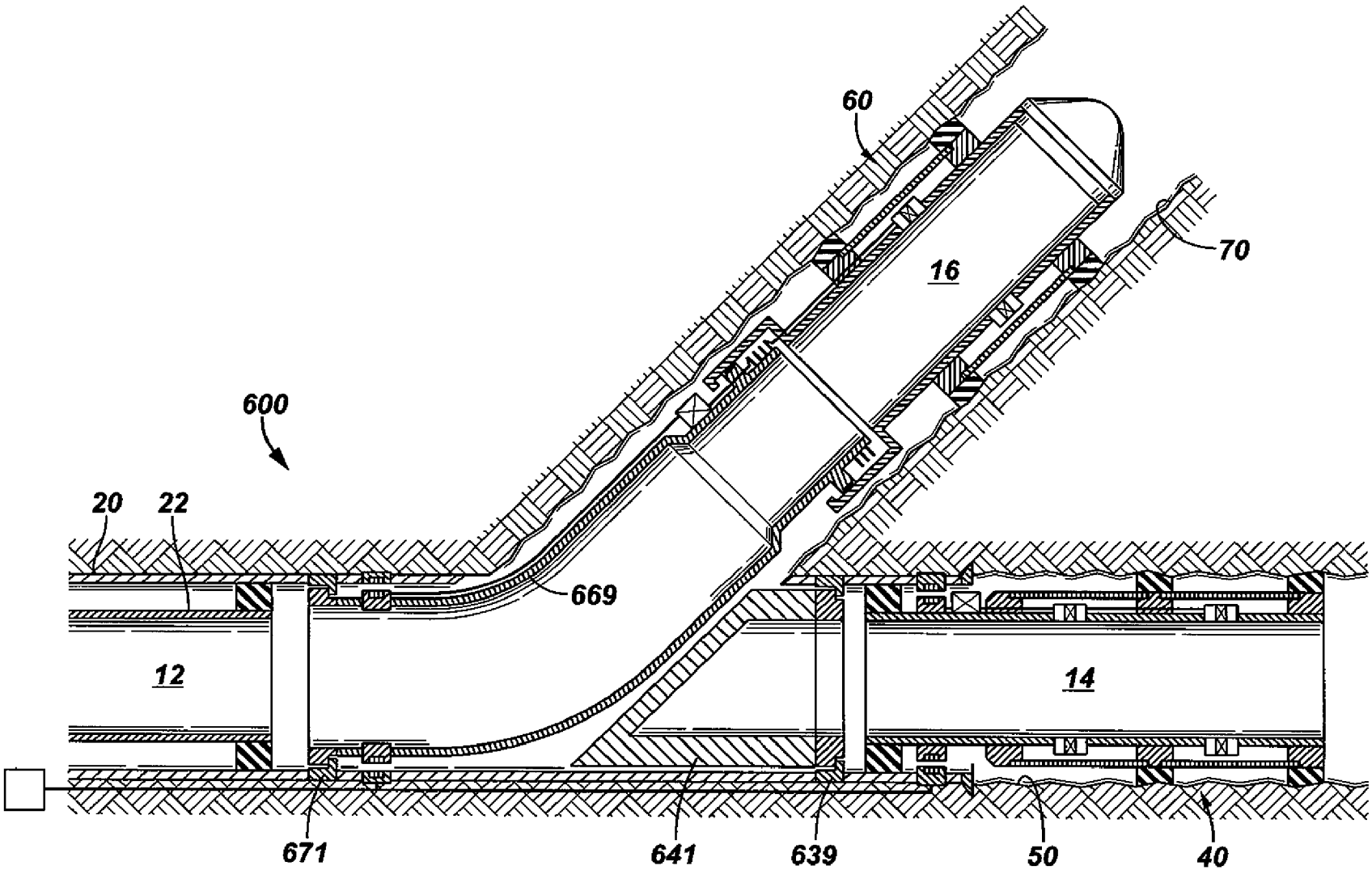
FIG. 6A is a cross-sectional schematic view of a well system with a multilateral branch in which a lower mother bore section is not in fluid communication with an upper mother bore section, in accordance with an embodiment of the invention.
Figure 6B:
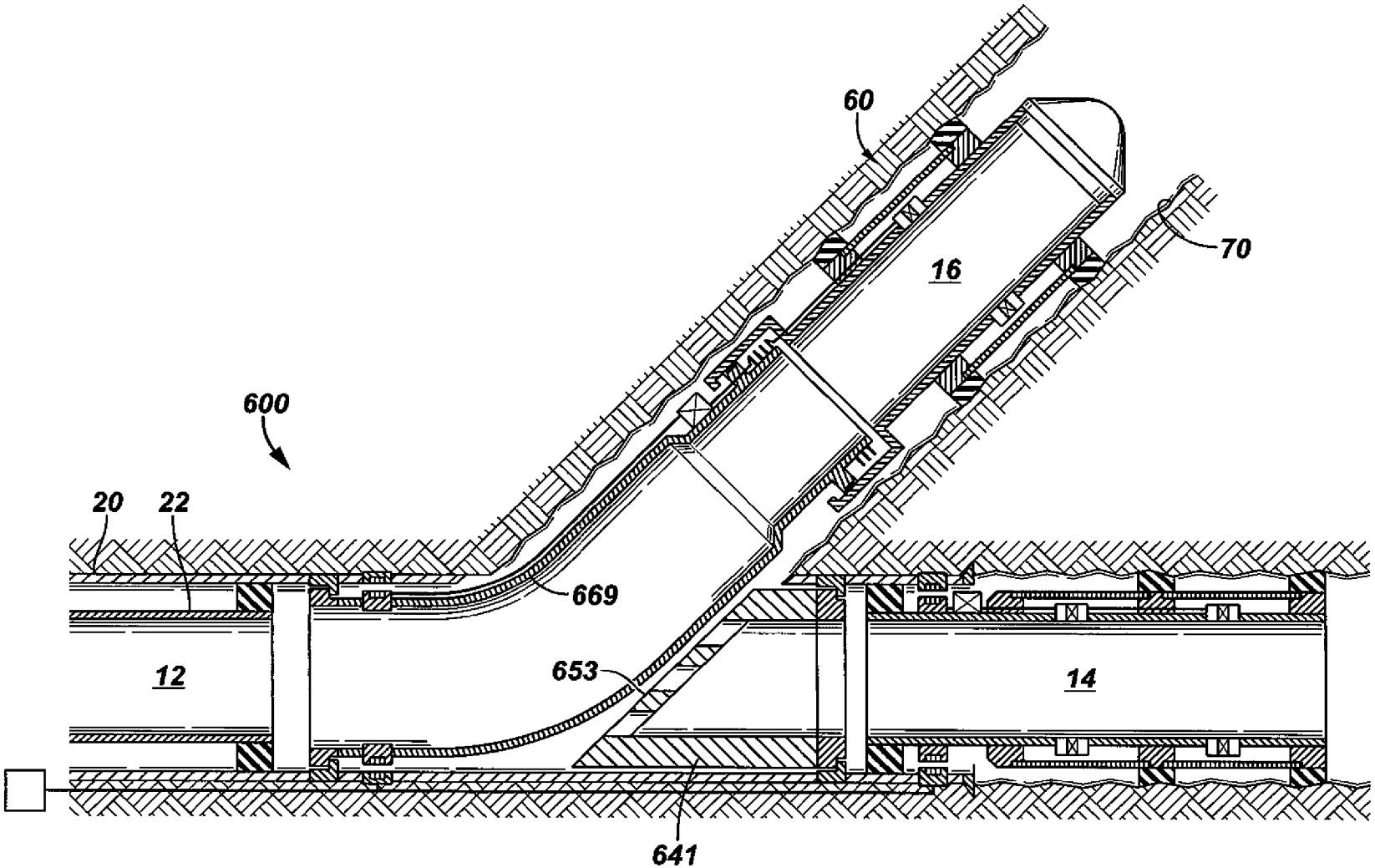
FIG. 6B is a cross-sectional schematic view of a well system with a multilateral branch in which a liner and deflector has been perforated in order to establish a fluid pathway there through, in accordance with an embodiment of the invention.

Referring generally to FIGS. 6A and 6B, these drawings illustrate exemplary steps that may be used in completing an embodiment of a well system 600 in which the well system 600 includes at least one multilateral branch 16. In the exemplary well system 600 shown, a main bore is initially drilled. Casing 20 with primary inductive couplers and cables attached to the exterior of the casing 20 may be run in hole and cemented in place. The main bore may be separated into an upper mother bore section 12 and a lower mother bore section 14. After cementing, the lower mother bore section 14 may be completed with completion 40 being located in a lower mother bore open hole 50. A deflector 641 may then be located above the completion 40 in the casing 20 through the use of a lower ICC 639. The multilateral branch section 16 may then be drilled.

After drilling, the multilateral branch section 16 may be completed with completion 60 being run into the multilateral branch section open hole 70. A liner 669 may be at least partially located above the completion 60 in the casing 20 through the use of an upper ICC 671. The use of ICC 639 and ICC 671 may help to align and orient primary and secondary inductive couplers to ensure ease of communication between the two. Of course, landings, and other devices may be used to increase the communicative efficiency of the primary and secondary inductive couplers, while decreasing transmission loss. Although an embodiment of the inductive coupler system similar to that described in FIG. 1 is shown in FIGS. 6A and 6B, any combination of the previous embodiments may be used to establish an inductive coupling system in an embodiment of the current invention.

After the multilateral branch section 16 is completed, production tubing 22 may be run and located within the casing 20. However at this point, as shown in FIG. 6A, the lower mother bore section 14 is not in fluid communication with the upper mother bore section 12. In order to establish fluid communication between the upper mother bore section 12 and the lower mother bore section 14, the liner 669 and deflector 641 may be perforated 653. Of course, in some embodiments the liner 669 may be perforated prior to running in production tubing 22. As shown in FIG. 6B, perforating the liner 669 and deflector 641 may open fluid pathways between the upper mother bore section 12 and the lower mother bore section 14.

Figure 7A:
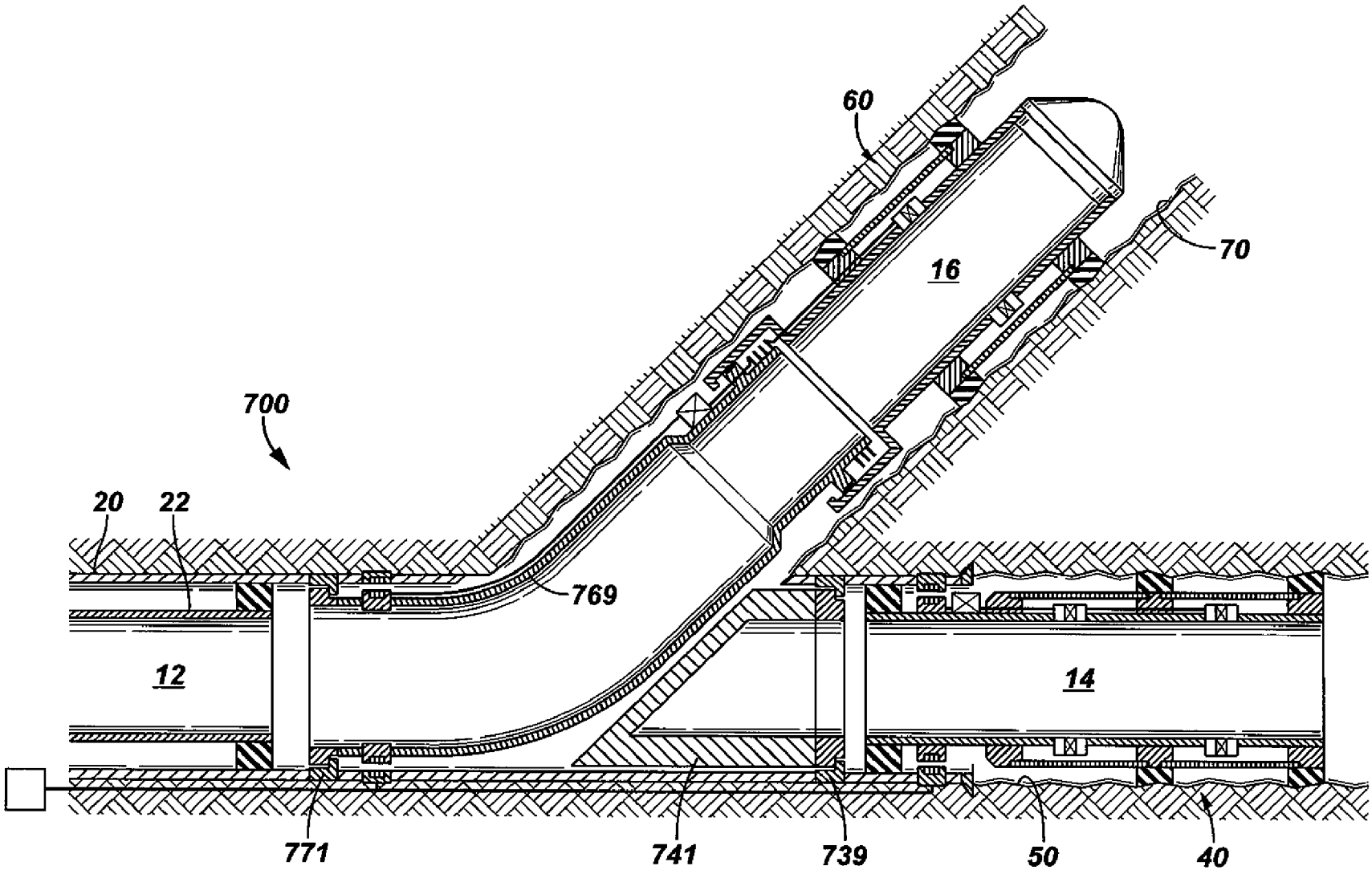
FIG. 7A is a cross-sectional schematic view of a well system with a multilateral branch in which a lower mother bore section is not in fluid communication with an upper mother bore section, in accordance with an embodiment of the invention.
Figure 7B:
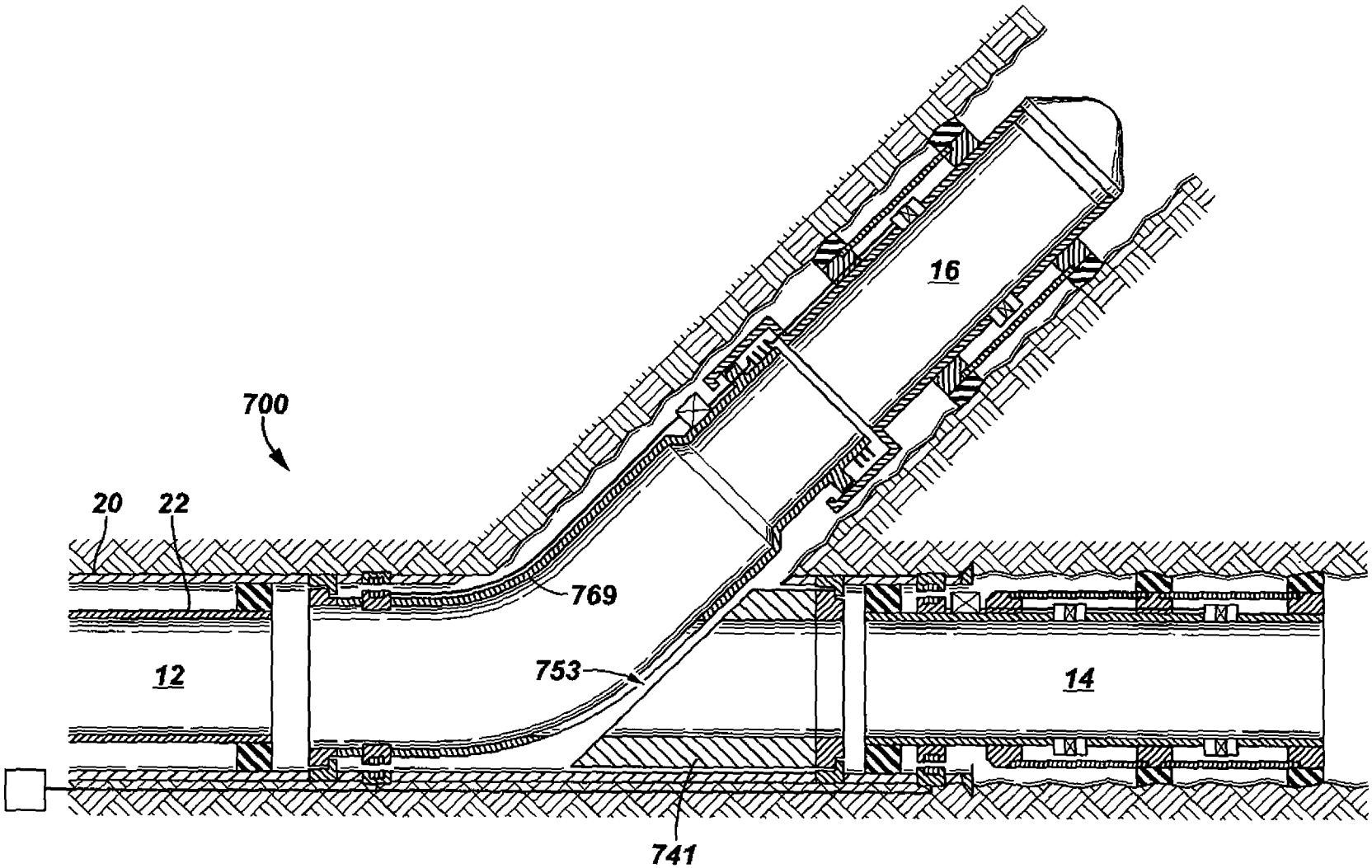
FIG. 7B is a cross-sectional schematic view of a well system with a multilateral branch in which a liner and deflector have been milled through in order to establish a fluid pathway there through, in accordance with an embodiment of the invention.

Turning now to FIGS. 7A and 7B, these drawings illustrate exemplary steps that may be used in completing an embodiment of a well system 700 in which the well system 700 includes at least one multilateral branch 16. In the exemplary well system 700 shown, an upper mother bore section 12, a lower mother bore section 14, and one multilateral branch section 16, are provided. To establish the exemplary well system 700, a main bore may be initially drilled. Casing 20 with primary inductive couplers and cables attached to the exterior of the casing 20 may be run in hole and cemented in place. The main bore may be separated into an upper mother bore section 12 and a lower mother bore section 14. After cementing, the lower mother bore section 14 may be completed with completion 40 located in a lower mother bore open hole 50. A deflector 741 may then be located above the completion 40 in the casing 20 through the use of a lower ICC 739. The multilateral branch section 16 may then be drilled.

After drilling, the multilateral branch section 16 may be completed with completion 60 extending into the multilateral branch section open hole 70. A liner 769 may be located at least partially above the completion 60 in the casing 20 through the use of an upper ICC 771. The use of ICC 639 and ICC 671 may help to align and orient primary and secondary inductive couplers to ensure ease of communication between the two. Of course, landings, and other devices may be used to increase the communicative efficiency of the primary and secondary inductive couplers, while decreasing transmission loss. Although an embodiment of the inductive coupler system similar to that described in FIG. 1 is shown in FIGS. 7A and 7B, any combination of the previous embodiments may be used to establish an inductive coupling system in an embodiment of the current invention.

After the multilateral branch section 16 is completed, production tubing 22 may be run and located within the casing 20. However at this point, as shown in FIG. 7A, the lower mother bore section 14 is not in fluid communication with the upper mother bore section 12. In order to establish fluid communication between the upper mother bore section 12 and the lower mother bore section 14, the liner 769 and deflector 741 may be milled through 753. Of course, in some embodiments the liner 769 may be milled through prior to running in production tubing 22. As shown in FIG. 7B, milling through the liner 769 and deflector 741 may open a fluid pathway between the upper mother bore section 12 and the lower mother bore section 14.

Figure 8:
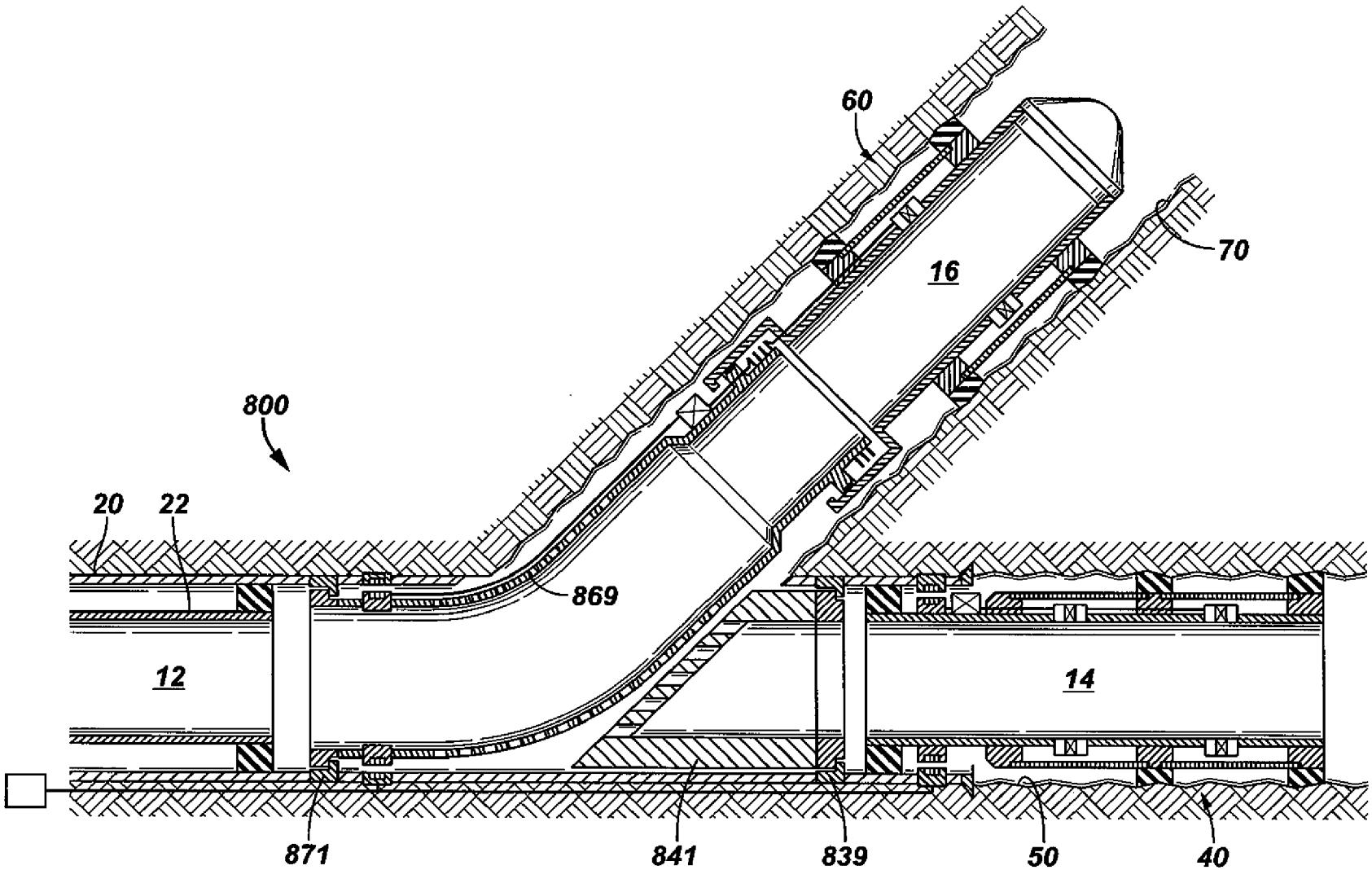
FIG. 8 is a cross-sectional schematic view of a well system with a multilateral branch in which a pre-perforated liner and deflector have been used in order to establish a fluid pathway there through, in accordance with another embodiment of the invention.

Referring generally to FIG. 8, this drawing illustrates an exemplary method that may be used in completing an embodiment of a well system 800 in which the well system 800 includes at least one multilateral branch 16. In the well system 800 shown, a main bore may be initially drilled. Casing 20 with primary inductive couplers and cables attached to the exterior of the casing 20 may be run in hole and cemented in place. The main bore may be separated into an upper mother bore section 12 and a lower mother bore section 14. After cementing, if needed, the lower mother bore section 14 may be completed with completion 40 being located in a lower mother bore open hole 50. A pre-perforated deflector 841 may be located above the completion 40 in the casing 20 through the use of a lower ICC 839. The multilateral branch section 16 may then be drilled.

After drilling, the multilateral branch section 16 may be completed with completion 60 extending into the multilateral branch section open hole 70. A pre-perforated liner 869 may be located above the completion 60 in the casing 20 through the use of an upper ICC 871. Production tubing 22 may then be run in hole and sealingly coupled with the casing 20. At this point, both the lower mother bore section 14 and the multilateral branch section 16 may be in fluid communication with each other and with the upper mother bore section 12. Although an embodiment of the inductive coupler system similar to that described in FIG. 1 is shown in FIG. 8, any combination of the previous embodiments may be used to establish an inductive coupling system in an embodiment of the current invention.

While the invention has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. A well system, comprising:

a first primary inductive coupler disposed on a casing and communicably coupled to a surface device;

a first secondary inductive coupler communicably coupled to the first primary inductive coupler and further communicably coupled to one or more completion components in a first portion of the casing;

a second primary inductive coupler communicably coupled to the surface device;

a second secondary inductive coupler communicably coupled to the second primary inductive coupler and further communicably coupled to one or more completion components in a second portion of the casing;

wherein flow through at least one of the first and second portions of the casing is adjusted via at least one of the one or more completion components, and wherein the first primary inductive coupler is communicably coupled to the surface device via a cable proximate to an exterior of the casing.

2. The well system as described in claim 1 wherein the first portion of the casing is a lateral branch and the second portion of the casing is located below a lateral branch junction.

3. The well system as described in claim 1 wherein the first portion of the casing is a first zone and the second portion of the casing is a second zone in the same bore.

4. The well system as described in claim 1 wherein the at least one of the one or more completion components is an active flow control device.

5. The well system as described in claim 1 wherein the first and second primary inductive couplers are communicably coupled via a cable proximate to an exterior of the casing.

6. The well system as described in claim 1 wherein the first and second primary inductive couplers are coupled to the casing and are run downhole with the casing.

7. The well system as described in claim 1 wherein the cable comprises a first cable and a second cable disposed on the exterior of the casing;

wherein the first primary inductive coupler is communicably coupled to the surface device via the first cable proximate to the exterior of the casing; and wherein the second primary inductive coupler is communicably coupled to the surface device via the second cable proximate to the exterior of the casing.

8. The well system as described in claim 7 wherein:

the surface device comprises a first surface device and a second surface device;

the first primary inductive coupler is communicably coupled to the first surface device via the first cable disposed on the exterior of the casing; and the second primary inductive coupler is communicably coupled to the second surface device via the second cable disposed on the exterior of the casing.

9. The well system as described in claim 8 wherein the first primary inductive coupler is communicably coupled to the first surface device via an electronic control module; and wherein the second primary inductive coupler is communicably coupled to the second surface device via the electronic control module.

10. The well system as described in claim 8 wherein the first primary inductive coupler is communicably coupled to the first surface device via a first electronic control module;

and wherein the second primary inductive coupler is communicably coupled to the second surface device via a second electronic control module.

11. The well system as described in claim 1 wherein the first and second primary inductive couplers are communicably coupled to the surface device via at least one electronic control module.

12. The well system as described in claim 1 wherein at least one of the one or more completion components is a sensor.

13. The well system as described in claim 1 wherein at least one of the one or more completion components is an energy storage device.

14. The well system as described in claim 1 wherein the second primary inductive coupler is communicably coupled to the surface device via the cable.

15. The well system as described in claim 1 wherein the first primary inductive coupler is disposed on the exterior of the casing.

16. The well system as described in claim 15 wherein the first secondary inductive coupler is disposed within the casing, and wherein the first primary inductive coupler is communicably coupled to the first secondary inductive coupler through the casing.

17. The well system as described in claim 1 wherein the first primary inductive coupler and the second primary inductive coupler are disposed on the exterior of the casing.

18. A well system, comprising:

a first secondary inductive coupler communicably coupled to a surface device;

a first primary inductive coupler disposed on a casing and communicably coupled to the first secondary inductive coupler and further communicably coupled to a second primary inductive coupler and a third primary inductive coupler;

a second secondary inductive coupler communicably coupled to the second primary inductive coupler and to one or more completion components provided in a first portion of the casing;

a third secondary inductive coupler communicably coupled to the third primary inductive coupler and to one or more completion components provided in a second portion of the casing;

wherein flow through at least one of the first and second portions of the casing is adjusted via at least one of the one or more completion components, and wherein the first primary inductive coupler and the second primary inductive coupler are communicably coupled via a cable proximate to an exterior of the casing.

19. The well system as described in claim 18 wherein the first portion of the casing is a lateral branch and the second portion of the casing is located below a lateral branch junction.

20. The well system as described in claim 18 wherein the first portion of the casing is a first zone and the second portion of the casing is a second zone in the same bore.

21. The well system as described in claim 18 wherein the at least one of the one or more completion components is an active inflow control device.

22. The well system as described in claim 18 wherein the first primary inductive coupler is communicably coupled to the second primary inductive coupler via a first cable; and wherein the first primary inductive coupler is communicably coupled to the third primary inductive coupler via a second cable.

23. A well system, comprising:

a first secondary inductive coupler communicably coupled to a surface device;

a second secondary inductive coupler communicably coupled to a surface device;

a first primary inductive coupler disposed on a casing and communicably coupled to the first secondary inductive coupler and further communicably coupled to a third primary inductive coupler;

a second primary inductive coupler disposed on the casing and communicably coupled to the second secondary inductive coupler and further communicably coupled to a fourth primary inductive coupler;

a third secondary inductive coupler communicably coupled the third primary inductive coupler and to one or more completion components provided in a first portion of the casing;

a fourth secondary inductive coupler communicably coupled to the fourth primary inductive coupler and to one or more completion components provided in a second portion of the casing; and wherein flow through at least one of the first and second portions of the casing is adjusted via at least one of the one or more completion components, and wherein the first primary inductive coupler and the third primary inductive coupler are communicably coupled via a cable proximate to an exterior of the casing.

24. The well system as described in claim 23, wherein the first secondary inductive coupler is communicably coupled to the surface device via a first cable; and wherein the second secondary inductive coupler is communicably coupled to the surface device via a second cable.

25. The well system as described in claim 24, wherein the first and second cables are proximate to an exterior surface of production tubing.

26. A method of completing a lateral wellbore comprising:

drilling a mother bore and running a lower bore completion;

locating a deflector above the lower bore completion using a first indexed casing component;

drilling a lateral bore and running a lateral bore completion;

locating a liner above the deflector using a second indexed casing component;

creating an orifice in the liner and the deflector to establish a fluid pathway there through;

wherein at least one completion component in the lower bore completion and the lateral completion is communicably coupled to a surface device via an inductive coupler.

27. The method as described in claim 26 wherein creating an orifice comprises perforating the liner and the deflector.

28. The method as described in claim 26 wherein creating an orifice comprises milling through the liner and the deflector.

29. The method as described in claim 26, wherein the deflector and the liner are both pre-perforated.

30. A method for completing a wellbore, comprising:

locating a casing in at least a portion of a primary borehole having one or more lateral boreholes extending therefrom and two or more inductive couplers disposed therein, wherein at least one of the two or more inductive couplers is communicably coupled to at least one surface device via one or more cables disposed on an exterior of the casing; and locating one or more completion components in at least one of the one or more lateral boreholes, wherein each completion component is communicably coupled to at least one of the two or more inductive couplers.

31. The method of claim 30, further comprising locating one or more completion components in the primary borehole, wherein the one or more completion components in the primary borehole are communicably coupled to at least one of the two or more inductive couplers in the primary borehole.

32. The method of claim 31, wherein the first and second cables are disposed in an annulus formed between the casing and the primary borehole.

33. The method of claim 30, wherein the one or more cables comprises a first cable that communicably couples the at least one inductive coupler to the surface device, and a second cable that communicably couples the one or more completion components in the primary borehole to at least one of the two or more inductive couplers in the primary borehole.

* * * * *